US006854801B2

(12) United States Patent
Nussbaum

(10) Patent No.: US 6,854,801 B2
(45) Date of Patent: Feb. 15, 2005

(54) ADJUSTABLE SLING CHAIR

(76) Inventor: Ursula Nussbaum, 34481 Calle Monte, Capistrano Beach, CA (US) 92652

( * ) Notice: Subject to any disclaimer, the term of this patent is extended or adjusted under 35 U.S.C. 154(b) by 0 days.

(21) Appl. No.: 10/437,523

(22) Filed: May 13, 2003

(65) Prior Publication Data

US 2003/0209927 A1 Nov. 13, 2003

Related U.S. Application Data

(60) Provisional application No. 60/379,811, filed on May 13, 2002.

(51) Int. Cl.[7] ..... A47D 13/10

(52) U.S. Cl. ..... 297/279; 297/280; 297/281

(58) Field of Search ..... 297/274, 276, 297/277, 282, 452.2, 440.24, 273, 281; 472/118; 248/317, 121, 158, 127

(56) References Cited

U.S. PATENT DOCUMENTS 491,172 A * 2/1893 Hart ..... 297/276
737,398 A * 8/1903 Grote ..... 297/184.1
3,730,587 A * 5/1973 Bloxham et al. ..... 297/274
4,188,063 A * 2/1980 Dusart ..... 297/273
4,221,429 A * 9/1980 Wade ..... 297/277
5,097,545 A * 3/1992 Hooi ..... 5/104
5,588,702 A * 12/1996 Litwin ..... 297/277
5,704,882 A * 1/1998 Coates et al. ..... 482/69
5,944,381 A * 8/1999 Nguyen ..... 297/281
5,971,480 A * 10/1999 Maschke ..... 297/273
6,364,412 B1 * 4/2002 Crawford ..... 297/273

FOREIGN PATENT DOCUMENTS

DE 29601285 * 5/1996

OTHER PUBLICATIONS

Advertisement from internet web site www.airchair.net.*
Advertisement from internet web site www.hammockusa.com.*
Advertisement from internet web site www.skychair.com.*

* cited by examiner

*Primary Examiner*—Milton Nelson, Jr.

(57) ABSTRACT

Methods and design for a sling chair are described, the sling chair has an adjustable backrest, footrest and headrest to achieve maximum comfort for a user. A stand for a sling chair of stable design is described as well.

21 Claims, 6 Drawing Sheets

ADJUSTABLE SLING CHAIR

CROSS REFERENCE TO RELATED APPLICATION

This patent application claims priority to U.S. Provisional Patent Application No. 60/379,811, Ursula Nussbaum inventor, filed on May 13, 2002 and entitled Adjustable Freestanding Island Chairs.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to chairs and more particularly to a method and construction of a sling or hammock type chair with improved features.

2. Description of Related Art

Hammock or sling type chairs are widely sold on the market, such as the Sky Chair™ or the Air Chair™. These sling chairs essentially comprise a sheet or sheets of flexible fabric material that is provided to support the torso of a user, supported at the four outward corners by a stand or suspended from ropes attached to an overhead structure, a tree branch or to a freestanding stand. These sling chairs tend to be short in the seat and back, offering minimal lower back support. Many lack sufficient headrests, armrests or an adjustable footrest attached to the sling chair, resulting in the body night not being optimally distributed for comfort and circulation. Many of such existing sling chairs are short in the seat and back areas and provide minimal lower back support; many offer no headrest, armrests or a footrest. Frequently the supporting structure members used are made out of wood, or use ropes or cables of unsafe construction.

It would be advantageous therefore to provide a sling chair that incorporates one or more improvements, a chair that is adjustable, that provides adequate support of the feet, neck and arms. It would further be advantageous to provide a sling chair that is easily disassembled, provided with a stand or rack of sufficient stability to provide reliable stability, allowing for easy transport and storage.

SUMMARY OF THE INVENTION

In one aspect the invention encompasses providing a method and construction of a sling chair comprised of a sling having backrest portion and a seat portion made of flexible fabric and formed to support a user. The sling has left and right sides corresponding to the left and right sides of a user. Loops are formed at the corners of the of the sling and one or more ropes are attached to each loop, the ropes are connected to an overhead structure to support the sling chair. A right pole member is attached at one end to the right rear loop and attached at the opposite end to the right front loop, a left pole member is attached at one end to the left rear loop and attached at the opposite end to the left front loop so as to hold the sling in an opened configuration. A cross pole member having right and left ends may be the overhead structure, the right end being attached by rope to both ends of the right pole member, the left end being attached by rope to both ends of the left pole member. If a cross pole member is used a connection rope is connected to the cross pole member suitable for hanging from another overhead structure.

A footrest made of suitable material for holding a user's feet is included, connected by ropes on either side to an overhead structure, such as the cross member. The footrest ropes may be adjustable in length, so that the relative height of the footrest is adjustable.

The ropes connecting the cross pole member to the right pole member at the right rear loop, and connecting the cross pole member to the left pole member at the left rear loop are adjustable in length as well, thereby allowing the pitch of the backrest to be adjusted by a user.

Armrest portions are also provided that hold substantially the whole length of a users arm. An adjustable headrest is provided as well, having a pillow section at one end and a counterweight section at the other end and draped over the backrest of the sling chair.

A design for connecting loops or ropes to poles is included where the end of a pole is slit and a loop, rope or D ring is attached to the rope by placing it in the slit. A sling chair stand of unique design that is easily assembled and disassembled is also provided. The stand is made of members connected with male/female connectors. A slight bend is incorporated in the back of the stand to more equally distribute the weight of the sling chair.

Methods of adjusting the footrest, pitch of the backrest and headrest to achieve maximum comfort for a user are also detailed.

DETAILED DESCRIPTION

The following detailed description, and the figures to which it refers, are provided for the purpose of describing example(s) and specific embodiment(s) of the invention only and are not intended to exhaustively describe all possible examples and embodiments of the invention. In the following various figures identical elements and features are given the same reference number, and similar or corresponding elements and features are or may be given the same reference numbers followed by an a, b, c, and so on as appropriate for purposes of describing the various embodiments of the present invention.

Figure 1:
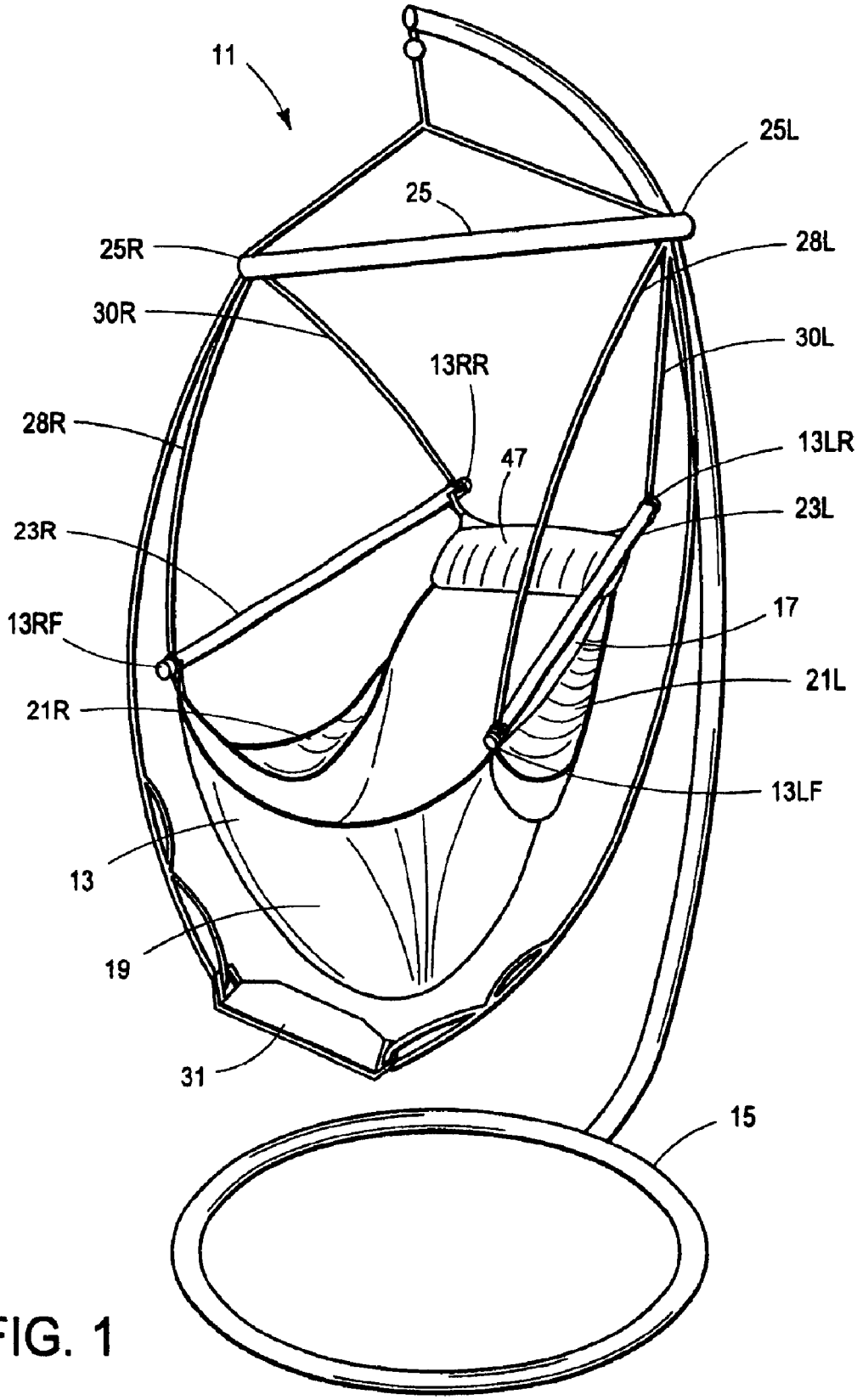
FIG. 1 is a front perspective view of an embodiment of a sling chair.
Figure 2:
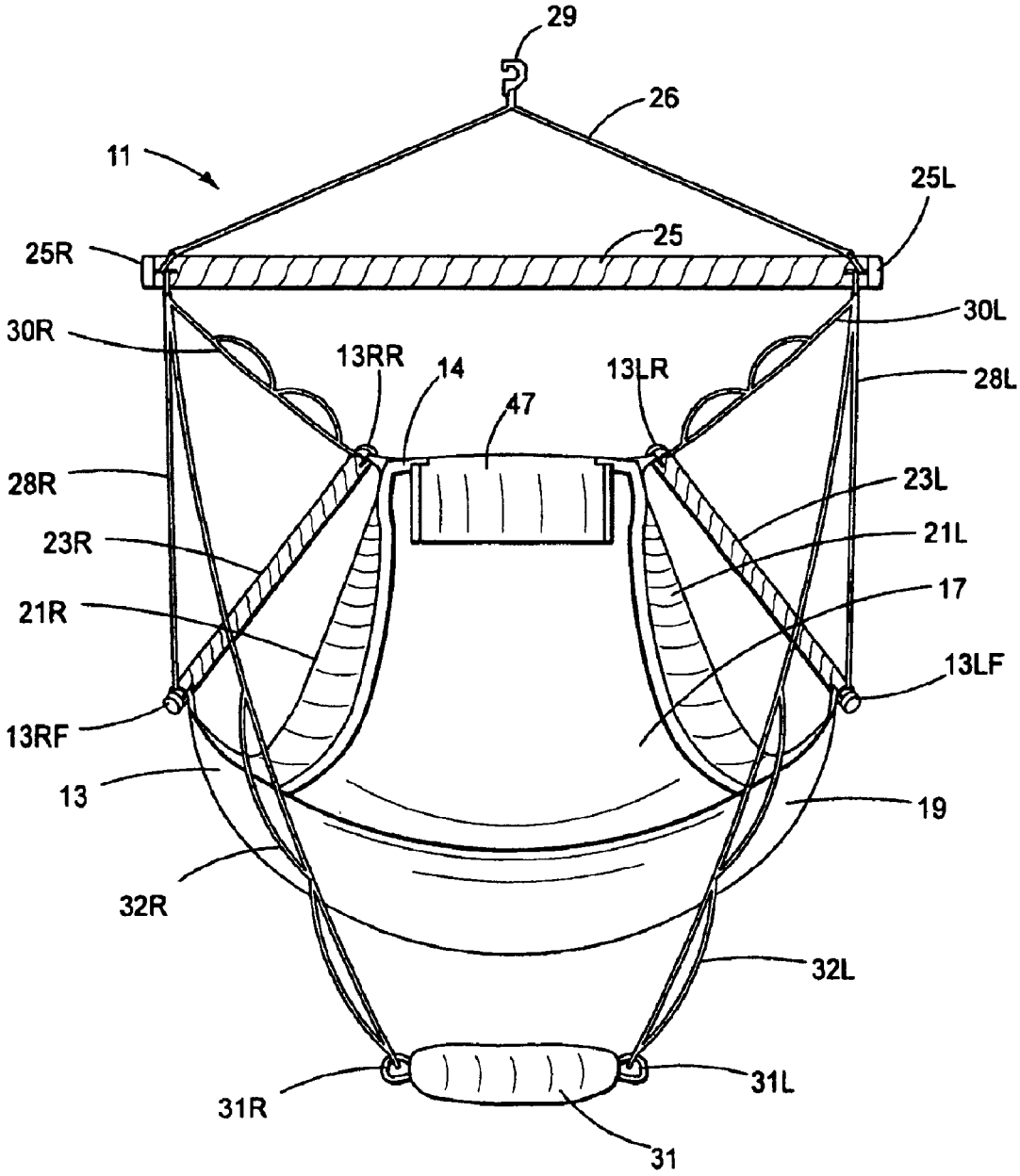
FIG. 2 is a front view of the sling chair of FIG. 1.

FIG. 1 is a left front perspective view of an embodiment of the sling chair 11 of the present invention hanging from a stand 15, FIG. 2 is a front view of the sling chair 11 not showing the stand 15. The sling 13 is of a construction that will be appreciated by those of skill in the art, where the sling 13 is made of flexible fabric such as canvas, having backrest 17 and seat 19 portions to support a user. The backrest 17 portion of the sling 13 is preferably formed so that a tall person (6'1" or taller) will still have his head supported, thus accommodating more users. Two additional sections, left and right armrests, 21L and 21R may optionally be incorporated into the sling 13. The seat portion 19 is formed to provide a deep seat for the user and preferably made with two layers of fabric for added support. The seams between the sections of the sling 13 are preferably stitched four times and reinforced with the strong polypropylene webbing (not shown) on the back side of the fabric, opposite where the user sits, and the edges are hemmed 14 with webbing as well. Loops 13LR, 13RR, 13LF and 13RF or equivalent attachment points, such as grommets, are formed at the corners of the sling 13, so that the sling will be supported by attachments to the loops at the four corners.

Sling 13 is suspended from an arrangement of ropes and rigid structural pole members to maintain the sling 13 in an opened configuration, rather than simply hanging as a formless fabric sack under its own weight. As shown in the figures, loop 13RR is attached to one end of right pole member 23R and loop 13RF is attached to the other end of 23R; likewise loop 13LR is attached to one end of left pole member 23L and loop 13LF is attached by rope to the other end of 23L. The front end of the left pole member 23L is also attached by rope 28L to one end 25L of a cross pole member 25; the rear end of 23L is attached by rope 30L to 25L as well. Cross pole member 25 is oriented above and substantially perpendicular to the left pole member 23L and right pole member 23R. Similarly the front end of the right pole member 23R is attached by rope 28R to the other end 25R of cross pole member 25; the rear end of 23R is attached by rope 30R to 25R as well. In this embodiment each end of cross pole member 25, 25L and 25R, is connected by connection rope 26 to allow rope 26 to be attached centrally to a convenient suspending structure, such as a roof overhang, tree branch or to a stand. Here connection rope 26 is centrally knotted to an eye swivel snap hook 29, which is provided to attach to a convenient overhead structure. The connection rope could also be an eye hook or the like placed directly in the center of cross pole member 25. A stand 15 is shown by way of an example of a convenient overhead structure, the stand 15 provides independent support the sling chair 11 as a freestanding sling chair.

Inch-wide flat polypropylene rope is preferred for the connections and the pole members, left pole member 23L, right pole member 23R and cross pole member 25 are preferably made of fiberglass tubing of about one inch outside diameter with a wall thickness of about two millimeters, providing strong support and holding up in diverse weather conditions.

Figure 3A:
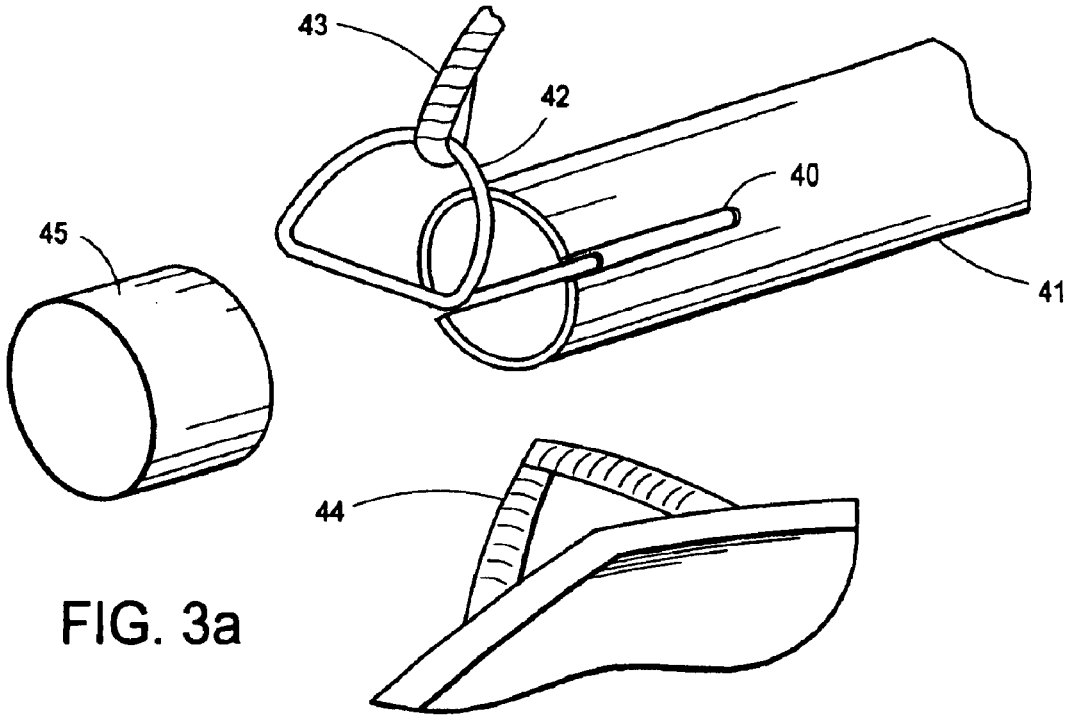
FIGS. 3*a* and 3*b* are exploded and assembled detail views of an embodiment of attaching poles used with a sling chair.
Figure 3B:
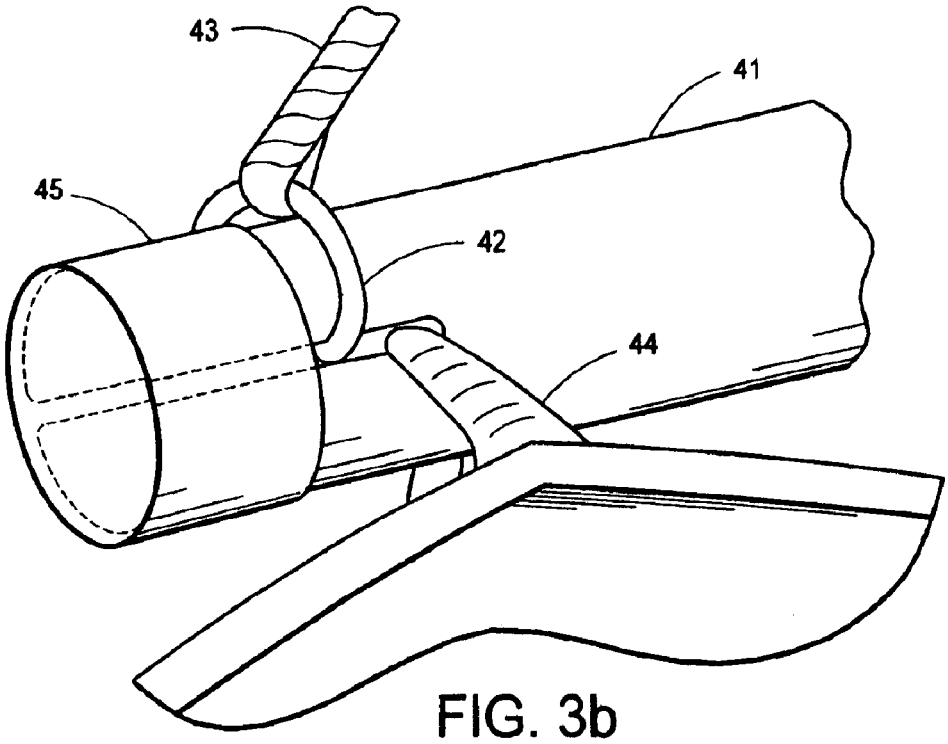

In the preferred embodiment the ropes and loops are attached to the ends of the pole members 23R, 23L and 25 according to the construction shown in FIGS. 3*a* and 3*b*. A slit 40 is formed in the end of a pole member, an exemplary pole member end shown here as 41. A rope 43 is attached to a "D" ring 42 and the D ring is slipped into the slit 40. A loop 44 may also be slipped into the slit 40. The end of the pole member is covered with an end cap 45. The use of slits to anchor D rings, ropes and/or loops allows the chair 11 to be easily disassembled.

Figure 4:
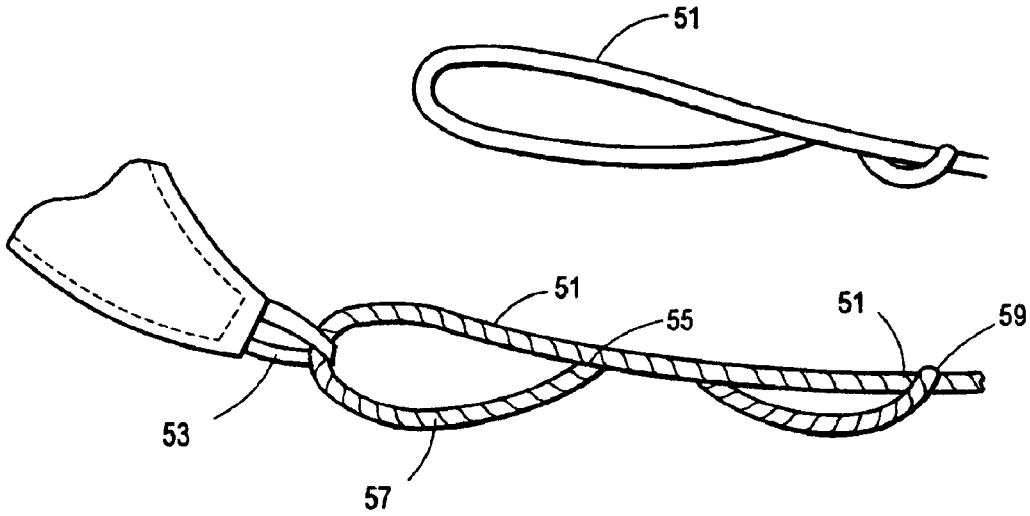
FIG. 4 is a side view of rope configured to allow cinching and length adjustment.

FIG. 4 shows a preferred embodiment for anchoring rope 51 to a loop 53 to allow the rope 51 to be cinched. The rope 51 is passed through an anchoring point such as loop 53 or D ring for connection to a pole (not shown) and then joined, at 55, to itself forming a rope loop 57 portion. The end of the rope 51 is then tied around itself by forming a slip knot 59, allowing the slip knot to be moved along the length of the rope and pull on the rope loop 57 to adjust the effective length. In the preferred embodiment ropes 30R and 30L are anchored to D rings in this manner, to cross pole member 25, allowing the length of ropes 30R and 30L to be cinched and hence adjustable in length. In this manner the pitch of the backrest 17 may be adjusted upwardly or downwardly to a desired elevation according to the preference of the user.

Armrest portions may also be incorporated in the sling 13. In the preferred embodiment of the present invention the armrests 21L and 21R are elongated to extend substantially the length between their respective corners, situated generally between loops 13RR–13RF and 13LR–13LF. Each armrest 21L and 21R is of sufficient length and width to support the length of an arm of a user. When a user sits in the sling chair 11, the weight of the user causes the sling chair to flex and the armrests 21L and 21R and drawn upwardly and stiffen to support the arms of the user.

In the preferred embodiment of the present invention a hanging footrest 31 is also provided. The footrest 31 comprised of a pad, fabric or even rigid material suitable for holding a user's feet, having loops 31L and 31R attached at opposite ends. Loop 31L is attached by rope 32L to cross pole member end 25L; loop 31R is attached rope 32R to cross pole member end 25R. Each rope 32L and 32R is configured in the cinching fashion of FIG. 4, with the rope anchored to an end of the cross pole member 25 by a rope loop and slip knot (examples shown as 57 and 59 in FIG. 4), thereby allowing the length of rope 32L to be cinched and hence adjustable in length. In this manner the footrest 31 may be adjusted upwardly or downwardly to a desired height according to the user. The adjustment is particularly important for shorter people, this adjustment allows the height of the footrest to be altered to an ideal height, believed to be hip height, for circulation in the user's body and releases pressure of lower back and spine.

Figure 5:
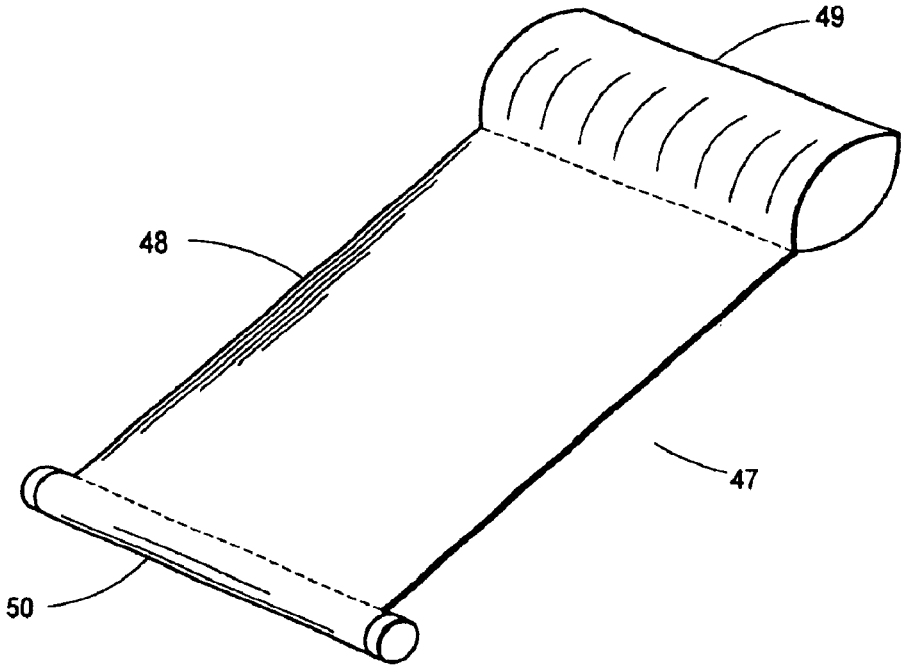
FIG. 5 is a perspective view of a headrest used with the present invention.

In the preferred embodiment a headrest is also provided, shown in FIG. 5. The headrest 47 is formed from a sheet of fabric 48 forming a pillow 49 section at one end and a counterweight 50 at the other end. The pillow section may be filled with suitable stuffing and a dowel or other ballast of suitable weight may be used as the counterweight 50 to balance the weight of the pillow. The headrest 47 is draped over the upper end of the backrest 17 so that the user may rest his head on the pillow 49, the counterweight 50 helps prevent the pillow from moving about the backrest.

Figure 6A:
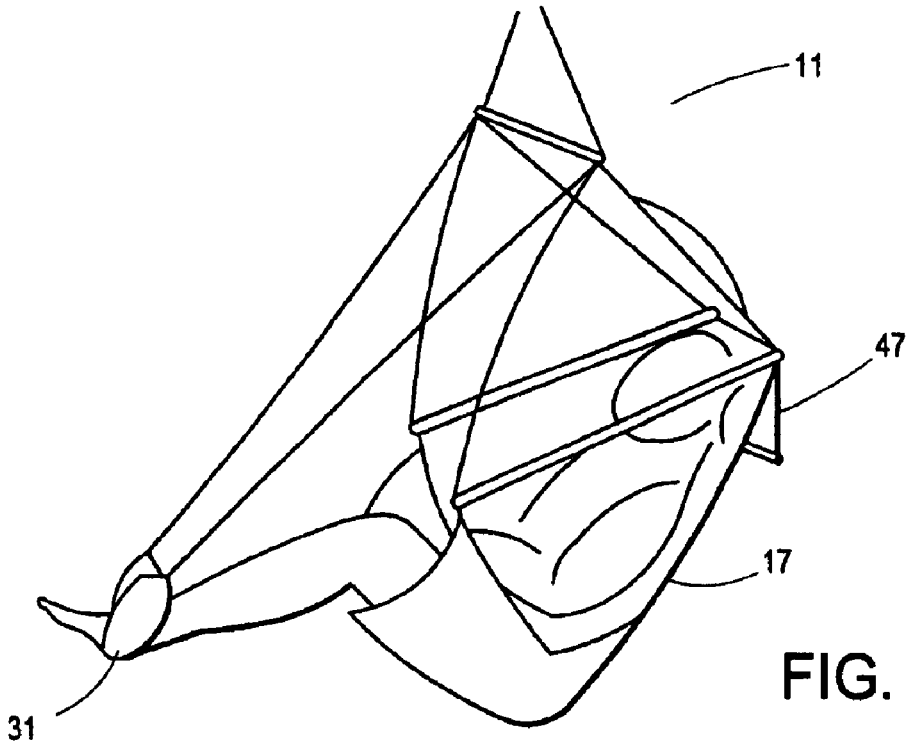
FIGS. 6*a* and 6*b* illustrate a method of using a sling chair.
Figure 6B:
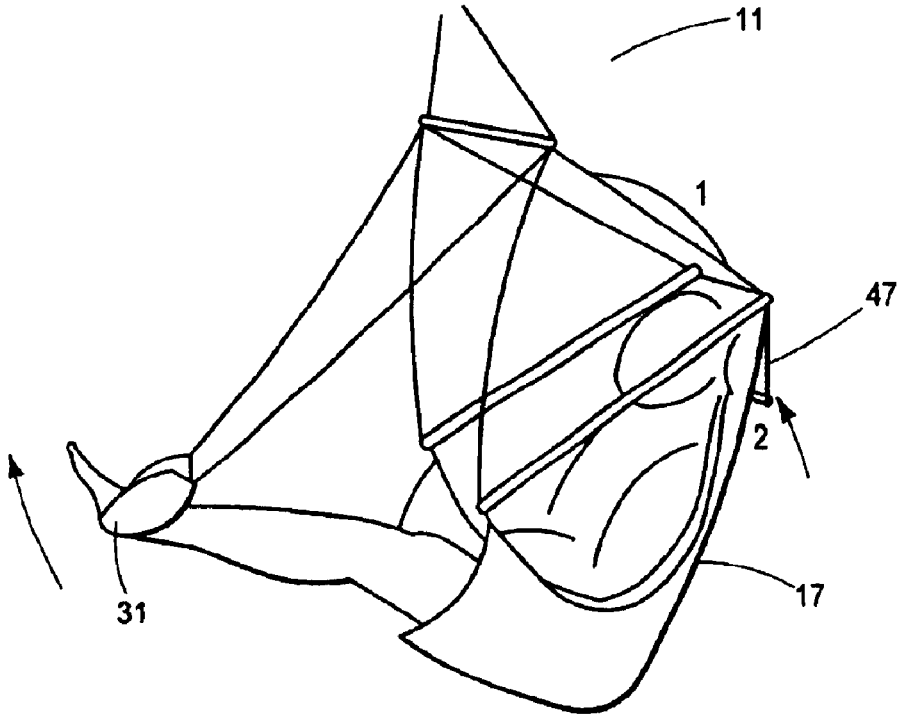

The present invention also provides for a method of adjusting for optimal comfort or circulation in a sling chair 13. As shown in FIGS. 6*a* and 6*b* the method includes the steps of a user sitting in a sling chair and further includes the step of checking the adjustment of and adjusting if required the height of the footrest 31 to achieve maximum comfort. The method may further include the steps of checking the adjustment of and adjusting if required the height of the backrest 17 and/or the headrest 47. In this manner weight on the neck, spine and lower back may be adjusted to achieve optimal comfort or blood circulation. FIG. 6*a* shows before and FIG. 6*b* shows a configuration where footrest 31, backrest 17 and headrest 47 are in adjustment (movement shown by arrows). Note that in this example backrest 17 did not have to be moved because it was initially in proper adjustment.

Figure 7:
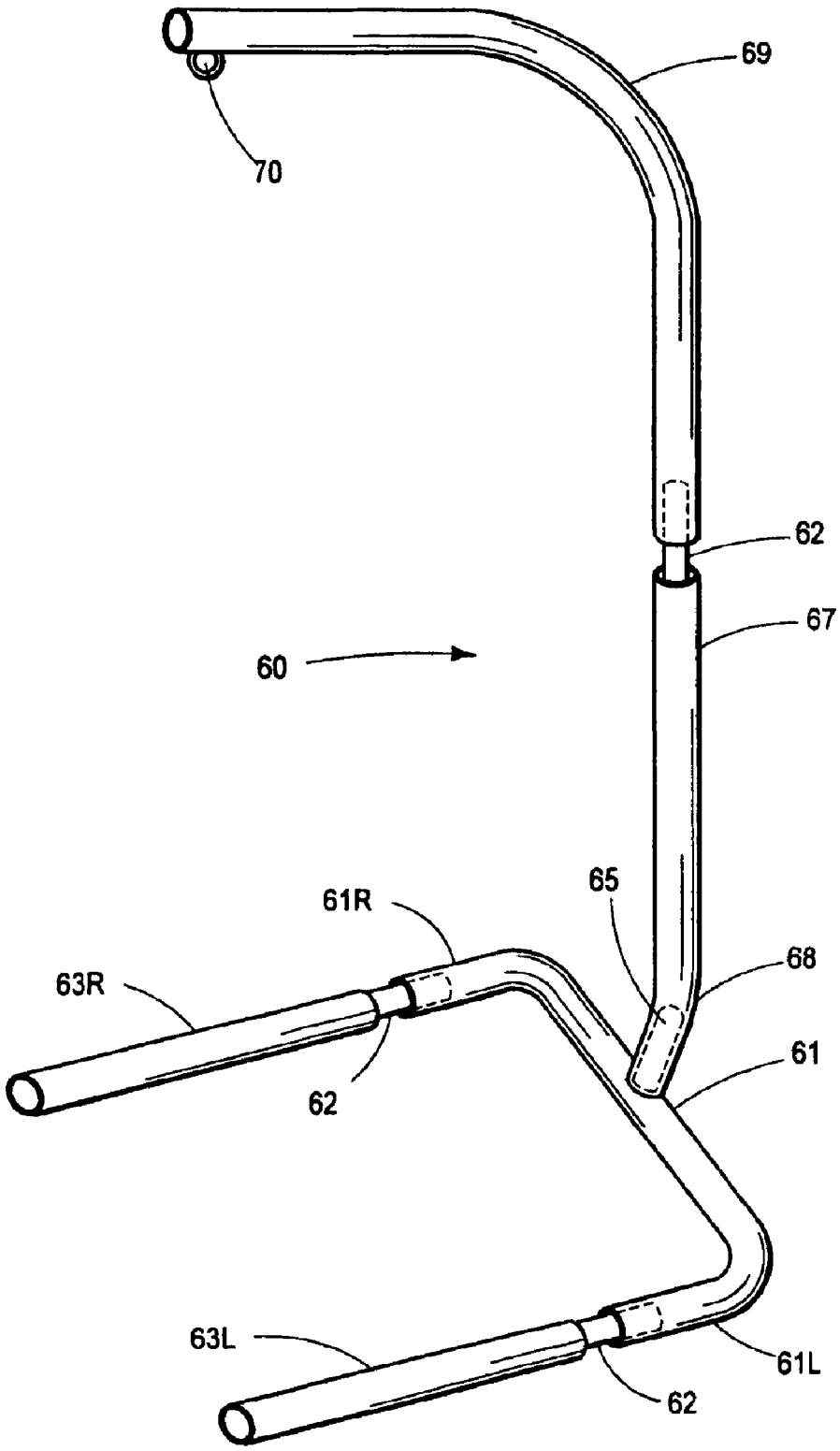
FIG. 7 is a side perspective view of an embodiment of a stand used with a sling chair.

In the preferred embodiment a stand is provided where a freestanding chair is desired. The stand 60, shown in FIG. 7, is made of high strength powder-coated steel pipe of about two-inches outside diameter with a wall thickness of about 1.25 millimeters. The stand is comprised of five pipe sections, 61, 63R, 63L, 67 and 69 that are connected with male/female connectors 62. The connectors, for example, may be pipe having an outside diameter just slightly less than the inside diameter of the pipe sections and the connectors 62 join the sections by being commonly inserted within two adjoining sections. A U-shaped fork member 61 has two ends, 61R and 61L, that are connected to two feet members 63R and 63L, respectively, together which form the base to be rested upon a surface. A male connector 65 is formed in the center of the fork 61, to project substantially upwardly when the base is resting upright on a surface, the male connector 65 is preferably oriented slightly backwardly, angled at about one hundred degrees from the orientation of the feet members 63R and 63L. Back member 67 is sized to receive the male connector 65 and when connected projects upwardly; preferably a slight bend 68 is included in the back member to correct for the angle of male connector 65. In this manner some weight is distributed on the side of the fork member 61 distal the feet members 63R and 63L.

One end of an arch member 69 is connected to the back member 67, the second end of arch member 69 is formed to be centrally located above the area bounded by the base 61 and the feet 63R and 63L. A hook 70 or other such affixing member may be formed at the second end of arch member 69 to provide an attachment point. The pipes can be held together with a friction fit and the weight of the chair 11 and/or a user, but pins fitted through openings drilled through adjoining male/female pipe segments (not shown) or similar device may also be used if desired for added security to assure the pieces remain assembled. This stand 60 provides for a strong and stable platform for the chair 11 that may be easily assembled and disassembled.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention. Moreover, it will be appreciated that although the invention has been described hereabove with reference to certain examples or preferred embodiments as shown in the drawings, various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. A sling chair adapted to be hung from an overhead structure, comprised of:

a sling having backrest portion and a seat portion made of flexible fabric and formed to support a user, having left and right sides corresponding to the left and right sides of a user, forming left front, right front, left rear and right rear corners of the sling;

attachment points are formed at the corners of the sling;

a footrest made of suitable material for holding a user's feet, having attachment points formed on opposite ends of the footrest, and a first footrest rope attached to an attachment point on one end of the footrest and a second footrest rope attached to the opposite attachment point, and the attachment point of each corner of the sling has a length of rope affixed to it so a user will be supported in the chair when the other end of the ropes attached to the right corners and the first footrest rope are affixed to an overhead structure at a first location, and the other end of the ropes attached to the left corners and the second footrest rope are affixed to an overhead structure at a second location.

2. The sling chair of claim 1 including an adjustable headrest formed from a sheet of fabric, having a pillow section at one end and a counterweight section at the other end and draped over the backrest portion of the sling.

3. The sling chair of claim 1 wherein the first footrest rope and the second footrest rope are adjustable in length to allow the relative height of the footrest to be adjusted.

4. The sling chair of claim 1, wherein the ropes attaching the corner attachment points of the sling to the first and second locations are attached to their respective corner attachment points by;

including right and left pole members, wherein one end of the right pole member is attached to the right rear corner attachment point and also to the right rear corner rope, and the opposite end of the right pole member is attached to the right front corner attachment point and also to the right front corner rope, the left pole member is attached at one end to the left rear corner attachment point and also to the left rear corner rope, and the opposite end of the left pole member is attached to the left front corner attachment point and also to the left front corner rope, thereby holding the front corners at a fixed distance from the back corners.

5. The sling chair of claim 4 wherein the rope connected to the right pole member end that is also affixed to the right rear corner attachment point, and the rope connected to the left pole member end that is also affixed to the left rear attachment point are each adapted to be adjustable in length, whereby the pitch of the backrest portion can be adjusted by a user.

6. The sling chair of claim 4 wherein one or more attachment points and ropes are attached to a pole member by providing a slit in the end of the pole member and by placing the rope or D ring attached to the rope in the slit, and attaching an attachment point to the same slit by placing a D ring attached to the attachment point in the slit or, where an attachment point is a loop, by placing the loop in the slit.

7. The sling chair of claim 6 further including an end cap placed over the end of a pole member after insertion of a loop, rope or D ring in the slit.

8. The sling chair of claim 4 wherein the sling further includes left and right armrest portions affixed along the edges of the left and right sides of the sling.

9. The sling chair of claim 8 wherein the armrest portions extend the length between the corners of the sling, sufficient to hold the upper and forearm portions of the arms of a user.

10. The sling chair of claim 4 further including an overhead structure where the overhead structure is a free-standing stand.

11. The sling chair of claim 10 where the stand comprises members connected with male/female connectors, and includes a U-shaped fork member having two ends, the fork member further having a male connector formed in the center of the fork member oriented at an angle substantially upwardly when the two ends of the fork member are resting upright on a surface, two feet members, one attached to one foot member attached to one end of the fork member and the other foot member attached to the other end of the fork member, the two ends of the fork member and the two feet member thereby together forming a base to be rested upon a surface, a back member connected to the male member of the fork member and an arch member connected at one end to the back member, and formed such that the end of the arch member distal the back member is centrally located above the area bounded by the fork member and the feet members.

12. The sling chair of claim 11 wherein the U-shaped fork member male connector is oriented in a direction distal the feet members to cause a portion of the back member to be on the side of the fork member opposite that of the feet members, thereby distributing some weight of the sling chair on the side of the fork member distal the feet members.

13. The sling chair of claim 4, further including a cross pole member having right and left ends that are adapted to be hung from an overhead structure, wherein the ropes attached to the right corners and the first footrest rope are also attached to the right end of the cross pole member, and the ropes attached to the left corners and the second footrest rope are also attached to the left end of the cross pole member.

14. The sling chair of claim 13, wherein the cross pole member is adapted to be connected to an overhead structure by including a connection rope affixed to the cross member.

15. The sling chair of claim 14 where the connection rope includes an eye swivel snap hook for adapting the sling chair to be connected to an overhead structure with the connection rope.

16. The sling chair of claim 14 further including an overhead structure where the overhead structure is a free-standing stand.

17. A method for adjusting a sling chair comprising the steps of:

providing a sling chair comprised of a sling having a backrest portion and a seat portion made of flexible fabric and formed to support a user, having left and right sides corresponding to the left and right sides of a user the sling further including attachment points formed at left front, right front and left rear and right rear corners of the sling;

a right pole member attached at one end to the right rear attachment point and attached at the opposite end to the right front attachment point, a left pole member is attached at one end to the left rear attachment point and attached at the opposite end to the left front attachment point so as to hold the sling in an opened configuration;

a cross pole member adapted to be hung from an overhead structure having right and left ends, the right end being attached by rope to both ends of the right pole member, the left end being attached by rope to both ends of the left pole member;

a footrest made of suitable material for holding a user's feet and having attachment points formed on opposite ends of the footrest, a first footrest rope that is adjustable in length connecting an attachment point on one end of the footrest to the left end of the cross member, a second footrest rope that is adjustable in length connecting the opposite attachment point to the right end of the cross member, and adjusting the length of the footrest ropes to alter the relative height of the footrest to achieve maximum comfort for a user.

18. The method of claim 17, further including the step of adjusting the length of the ropes connecting the rear right pole member end to the right end of the cross pole member and adjusting in length the rope connecting the rear left pole member to the left end of the cross pole member to alter the relative pitch of the backrest portion to achieve maximum comfort for a user.

19. The method of claim 17 wherein the sling chair further includes an adjustable headrest formed from a sheet of fabric, having a pillow section at one end and a counter-weight section at the other end and the headrest is draped over the backrest portion and further includes the step of adjusting the height of the pillow to achieve maximum comfort for a user.

20. A stand for a sling chair, comprising:

members connected with male/female connectors, the members including a U-shaped fork member having two ends, the fork member further having a male connector formed in the center of the fork member oriented at an angle substantially upwardly when the two ends of the fork member are resting upright on a surface, two feet members, one foot member attached to one end of the fork member and the other foot member attached to the other end of the fork member, the two ends of the fork member and the two feet members thereby together forming abase to be rested upon a surface, a back member connected to the male connector of the fork member and an arch member connected at one end to the back member, formed such that the end of the arch member distal the back member is centrally located above the area bounded by the fork member and the feet members.

21. The stand of claim 20 wherein the U-shaped fork member male connector is oriented in a direction distal the feet members to cause a portion of the back member to be on the side of the fork member opposite that of the feet members, thereby distributing some weight of the sling chair on the side of the fork member distal the feet members.

* * * * *